United States Patent [19]

Drawe

[11] 3,960,445

[45] June 1, 1976

[54] COLOR HIGHLIGHTING ELECTROPHOTOGRAPHIC PRINTING MACHINE

[75] Inventor: William A. Drawe, Penfield, N.J.

[73] Assignee: Xerox Corporation, Stamford, Conn.

[22] Filed: Feb. 13, 1974

[21] Appl. No.: 442,037

[52] U.S. Cl. ..... 355/4; 355/24

[51] Int. Cl.² ..... G03G 15/22

[58] Field of Search ..... 355/3 R, 4, 7, 24, 40; 101/174, 211, DIG. 13; 271/9, 64, 65, 3.1

[56] References Cited

UNITED STATES PATENTS

| | | | |
|---|---|---|---|
| 3,506,347 | 4/1970 | Carlson | 355/17 X |
| 3,612,677 | 10/1971 | Langdon et al. | 355/4 |
| 3,630,607 | 12/1971 | Korn et al. | 355/6 |

*Primary Examiner*—L. T. Hix
*Assistant Examiner*—Kenneth C. Hutchison
*Attorney, Agent, or Firm*—H. Fleischer; J. J. Ralabate; C. A. Green

[57] ABSTRACT

An electrostatographic printing machine in which a plurality of original documents are employed to create successive powder images which are transferred to a common sheet of support material. The sheet of support material is advanced along one of a plurality of selectable paths from a supply station to a receiving station. One path is arranged to move the sheet of support material to the receiving station. The other path is adapted to recirculate the sheet of support material so as to enable successive powder images to be transferred thereto. In operation, the first original is placed in the printing machine and the powder image corresponding thereto is transferred to the support material. Thereafter, the next original is placed in the printing machine and the support material is recirculated. The second powder image corresponding to the second original is then transferred to the support sheet.

7 Claims, 4 Drawing Figures

COLOR HIGHLIGHTING ELECTROPHOTOGRAPHIC PRINTING MACHINE

BACKGROUND OF THE INVENTION

This invention relates to an electrostatographic printing machine, and more particularly concerns a color electrophotographic printing machine wherein red, black, or red and black information may be formed on one or both sides of a copy sheet.

In electrostatographic printing an electrostatic latent image is created and reproduced in viewable form. The process of electrostatographic printing includes electrophotographic printing and electrographic printing. Electrophotographic printing employs a photosensitive medium to form, with the aid of electromagnetic radiation, an electrostatic latent image. Contrawise, electrographic printing utilizes an insulating medium to form, without the aid of electromagnetic radiation, the electrostatic latent image. Hereinafter, an electrophotographic printing machine will be described as an illustrative embodiment of the inventive concept described in the present application.

In the process of electrophotographic printing, for example, as disclosed in U.S. Pat. No. 2,297,691 issued to Carlson in 1942, a photoconductive member is charged to a substantially uniform potential thereby sensitizing its surface. Thereafter, the charged photoconductive surface is exposed to a light image of an original document. In the irradiated areas, the charge is selectively dissipated in accordance with the intensity of the light image transmitted thereto. This records thereon an electrostatic latent image corresponding to the original document. Development of the electrostatic latent image is achieved by bringing a developer mix into contact therewith. A typical developer mix employs colored heat settable plastic particles known generally as toner particles, which are mixed with ferromagnetic granules, i.e. carrier granules. The developer mix is selected such that the toner particles acquire the appropriate charge relative to the electrostatic latent image recorded on the photoconductive surface. As the developer mix is moved into contact with the photoconductive surface, the greater attractive force of the electrostatic latent image causes the toner particles to be separated from the carrier granules and adhere to the electrostatic latent image. The toner powder image adhering to the electrostatic latent image is, then, transferred to the sheet of support material. A suitable sheet of support material is paper, or a plastic sheet, amongst others. Subsequently, the toner powder image is permanently affixed thereto.

Essentially, multi-color printing repeats the foregoing process a plurality of cycles. For example, U.S. Pat. No. 3,531,195 issued to Tanaka et al. in 1970 discloses a multi-color electrophotographic printing machine. As recited therein, the light image is filtered to record an electrostatic latent image on the photoconductive surface corresponding to one color of the original document. The electrostatic latent image is then developed with toner particles complementary in color to the filtered light image. Thereafter, the toner powder image is transferred to the sheet of support material. The foregoing process is repeated for a successively different colored light image. In this manner, a plurality of toner powder images are transferred to the sheet of support material, in superimposed registration with one another. As described in Tanaka, each toner powder image is fused after being transferred to the sheet of support material.

Since the advent of electrophotographic printing, various machines and devices have been developed to incorporate the teachings thereof in a manner to create simplex and duplex copies on a commercial basis. For the most part, these machines are limited to making a specified number of copies from an original on one or both sides thereof. For example, U.S. Pat. No. 3,592,462, 3,630,607 and 3,615,129 are all directed to various techniques for achieving duplexing, i.e. reproducing the information contained in an original document on one or both sides of the copy sheet. However, none of the prior art appears to disclose any technique for producing copy sheets having areas color highlighted on one or both sides thereof. For example, no technique has been described wherein the first side may have a portion reproduced in black and a portion highlighted in red. Similarly, no approach has been developed for reproducing an original document such that both sides of the copy sheet have portion thereof in black and other portions thereof highlighted in red.

Accordingly, it is a primary object of the present invention to improve electrophotographic printing so as to create copies having color highlighted portions.

SUMMARY OF THE INVENTION

Briefly stated, and in accordance with the present invention, there is provided an electrostatographic printing machine in which successive powder images are transferred to a sheet of support material.

This is achieved in the present instance by having successive powder images transferred from an image bearing member to a sheet of support material, each powder image having the information contained in one of a plurality of original documents. Means are provided for advancing the sheet of support material along one of a plurality of selectable paths from a supply station to a receiving station. One path is arranged to move the sheet of support material to the receiving station. Another path is adapted to recirculate the sheet of support material to move the sheet of support material to the receiving station with successive powder images transferred to a common surface thereof. In addition, means are also provided for selecting the path along which the sheet of support material moves.

BRIEF DESCRIPTION OF THE DRAWINGS

Other objects and advantages of the present invention will become apparent upon reading the following detailed description and upon reference to the drawings, in which.

Figure 1:
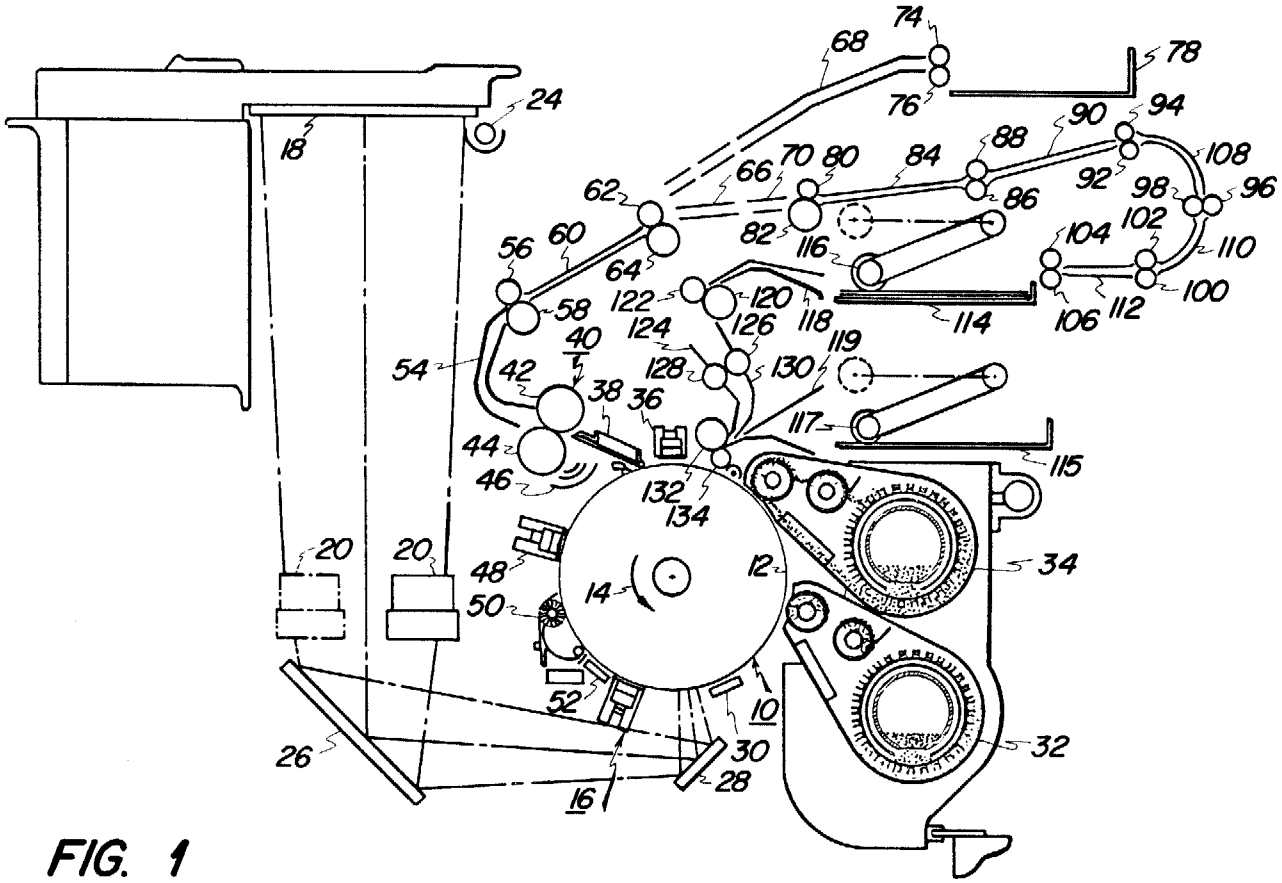
FIG. 1 is a schematic view of an electrophotographic printing machine incorporating the features of the present invention therein.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of the disclosed electrophotographic printing machine of the present invention, continued reference is had to the drawings. In the drawings, like reference numerals have been used throughout to designate like elements. Although the electrophotographic printing machine of the present invention is particularly well adapted for producing black and white copies, it should become evident from the following discussion that it is equally well suited for producing red copies or combinations of black and red copies and is not necessarily limited to the particular embodiment described herein.

As depicted in FIG. 1, the electrophotographic printing machine employs an image bearing member or photoconductive member having a drum 10 mounted rotatably within the machine frame (not shown). Photoconductive surface 12 is secured to the surface of drum 10. Preferably, photoconductive surface 12 has a panchromatic response to light of all colors. One type of suitable photoconductive material is disclosed in U.S. Pat. No. 3,655,377 issued to Sechak in 1972. Drum 10 is rotated in the direction of arrow 14 so as to pass sequentially through a series of processing stations. A drive system (not shown) rotates drum 10 at a predetermined speed relative to the processing stations. The operation of each station is coordinated with the movement of drum 10 to produce the proper sequence of events.

Initially, drum 10 rotates photoconductive surface 12 through charging station A. At charging station A, a corona generating device, indicated generally at 16, extends across photoconductive surface 12. Corona generating device 16 sprays ions onto photoconductive surface 12 producing a relatively high, substantially uniform charge thereon. One type of suitable corona generating device is described in U.S. Pat. No. 2,778,946 issued to Mayo in 1957.

After photoconductive surface 12 is charged to a substantially uniform potential, drum 10 is rotated to exposure station B. At exposure station B, light image of the original document is projected onto charged photoconductive surface 12. The original document to be reproduced, such as a sheet of paper, book or the like, is placed face down upon transparent viewing platen 18. Exposure station B includes a moving lens system, generally designated by the reference numeral 20 and scan lamps 24. Lamp 24 is adapted to move in a timed relation with lens 20 to scan successive incremental areas of the original document disposed upon platen 18. As shown in FIG. 1, a folded optical system is employed which includes an object mirror 26, a movable lens 20, and an image mirror 28. The optical system produces a light image of the original document which is directed onto charged photoconductive surface 12. Lens 20 is disposed beneath platen 18 and is arranged for movement in a path parallel to the plane of platen 22. The foregoing moves in a timed relation with the movement of lamp 24. The original document supported by platen 18 is thus scanned in a timed relationship with the movement of photoconductive surface 12 so as to project a light image corresponding to the original document thereon.

Positioned adjacent to exposure station B is a fade-out panel 30. Fade-out panel 30 is arranged to expose photoconductive surface 12 in the areas between successive electrostatic latent images found. These non-image areas are not developed as drum 10 moves through development station C since fade-out panel 30 reduces the charge on photoconductive surface 12 below the level required for development.

Next, adjacent to exposure station B is a developing station C. At developing station C, two individual developer units, generally indicated by the reference numerals 32 and 34 respectively, are arranged to render visible the electrostatic latent image recorded on photoconductive surface 12. Preferably, the developer units are all of a type generally referred to in the art as "magnetic brush developer units". Typical magnetic brush systems employ a magnetizable developer mix which includes carrier granules and toner particles. In general, the toner particles are heat settable. The developer mix is continually brought through a directional flux field to form a brush thereof. The electrostatic latent image recorded on photoconductive surface 12 is brought into contact with the brush of developer mix. Toner particles are attracted from the developer mix to the latent image. Each of the developer units contain appropriately colored toner particles. For example, one developer unit may contain black toner particles while the other developer unit contains red toner particles.

Positioned next and adjacent to the developing station is the image transfer station D which includes sheet feeding and registering means adapted to feed individual sheets of paper successively to photoconductive surface 12 in coordination with the developed image thereon. The transfer of the toner powder image from photoconductive surface 12 to the sheet of support material is effected by means of a corona generating device 36. Corona generating device 36 is located at or immediately after the point of contact between the sheet of support material and photoconductive surface 12. Corona generating device 36 is substantially similar to corona generating device 16 employed at charging station A. In operation, the electrostatic field created by corona discharge device 36 is effective to tack the sheet of support material electrostatically to photoconductive surface 12, whereby the sheet of support material moves synchroneously with drum 10 while in contact with photoconductive surface 12. Simultaneously, with the tacking action, the electrostatic field attracts the toner particles from photoconductive surface 12 and forces the particles to adhere electrostatically to the surface of the sheet of support material. Subsequent to transfer station D is positioned a plurality of mechanical stripper fingers adapted to come into contact with the lower leading edge of the sheet of support material to strip the leading edge of the sheet of support material from photoconductive surface 12. The stripper fingers are shaped to direct the sheet material towards vacuum transport 38. The sheet is held in contact with the bottom surface of the vacuum transport by means of vacuum ports positioned therein. The sheet of support material, a portion of which is electrostatically adhered to photoconductive surface 12 is moved along the vacuum support towards fuser assembly 40 at fixing station F as drum 10 rotates in the direction of arrow 14.

At fusing station F, the sheet of support material with the toner powder image thereon is moved along vacuum transport 38 into the nip between upper fuser roller 42 and lower fuser roller 44. The rolls of fuser 40 apply pressure while advancing the sheet of support material. Radiant source of energy 46 is adjacent to lower roller 44 and transfers heat energy to the surface of the lower roller. The lower roller is brought into thermal contact with the sheet of support material it rotates. Toner powder image fixing is accomplished by a combination of pressure and heat energy transferred to the powder image as it is forwarded through fuser 40. The sheet of support material, with the toner powder image permanently affixed thereto, is transported through the sheet feeding path for removal from the printing machine or for recirculation. Prior to describing the sheet feeding path in detail, the remaining processing stations of the electrophotographic printing machine will be discussed.

Although a preponderance of the toner particles are transferred to the sheet of support material, invariably some residual toner particles remain on photoconductive surface 12 after the transfer of the powder image therefrom. The final processing station, cleaning station E, removes these residual toner particles from photoconductive surface 12. Initially, the residual toner particles are brought under the influence of a cleaning corona generating device 48 adapted to neutralize the electrostatic charge remaining on the residual toner particles and photoconductive surface 12. Residual toner particles are then cleaned from photoconductive surface 12 by a rotatably mounted fibrous brush 50 in contact with photoconductive surface 12. A suitable brush cleaning device is described in U.S. Pat. No. 3,590,412 issued to Gerbasi in 1971.

Positioned after cleaning station F is an electroluminescent panel 52 which further discharges photoconductive surface 12 to substantially eliminate any residual charge remaining thereon. In this manner, each successive charge deposited by corona generating device 16 on photoconductive surface 12 substantially raises the photoconductive surface to the same potential.

Figure 4:
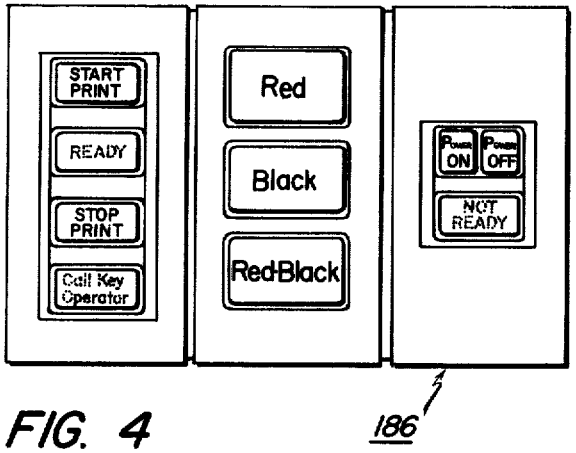

With continued reference to FIG. 1, after the sheet of support material with the toner powder image affixed permanently thereto exits fuser 40, guide members 52 in conjunction with advancing rollers 56 and 58 move the support material therealong. All of the guide members hereinafter described are pairs of spaced, arcuate sheet members adapted to direct the movement of the sheet or support material therebetween. Advancing rollers 56 and 58 move the sheet of support material into guide members 60. Thereupon, advancing rollers 62 and 64 move the sheet of support material along guide members 60. Next, adjacent thereto is guide member 68. Guide member 66 is pivotably mounted so as to place guide member 60 in communication with guide members 68 or 70, respectively. The positioning of guide member 66 is determinative of the mode of operating in which the printing machine will operate. For example, as shown in FIG. 1, guide member 66 is located in the recirculating mode wherein successive toner powder images are transferred to common surface of the sheet of support material. The mode of operation is determined by the appropriate button selected by the operator as shown in FIG. 4. Movement of guide member 66 is achieved by a solenoid (not shown) operatively associated therewith. The solenoid and suitable circuitry associated therewith are actuated by the depression of one of the selector buttons shown in FIG. 4. This positions guide member 66 in the corresponding mode of operation. For example, in the single image mode, guide member 66 is placed in communication with guide member 68 so that advancing roller 74 and 76 may move the sheet of support material with a single toner powder image affixed thereto into catch tray 78 for subsequent removal therefrom by the machine operator. Contrawise, if two successive toner powder images are to be affixed to the sheet of support material on a common surface thereof, guide member 66 will be positioned in communication with guide member 70. In this manner, advancing rollers 80 and 82 move the sheet of support material with the single toner powder image affixed thereto into guide member 84. Advancing rollers 86 and 88 then move the sheet of support material along guide member 84 and into guide member 90. Similarly, advancing rollers 92 and 94 move the sheet of support material along guide member 90 and into guide member 108. Thereupon, advancing rollers 96 and 98 move the sheet of support material therealong into guide member 110 whereupon advancing rollers 100 and 102 move the sheet of support material into guide member 112. Advancing rollers 106 and 104 thereupon move the sheet of support material into auxiliary tray 114. The sheet feeding apparatus which is adapted to advance the sheets of support material disposed in tray 114 comprises rollers 115 mounted fixedly on a shaft mounted rotatably in a pivotable arm. The arm is adapted to pivot so as to place the rollers in contact with the uppermost sheet disposed in tray 114. Rollers 116 move the sheet of support material from tray 114 into guide members 118. Advancing rollers 120 and 122 move the sheet of support material therealong into guide member 126. Thereupon, advancing rollers 126 and 128 move the sheet of support material with one toner powder image affixed thereto into guide member 130. Advancing rollers 132 and 134 move the sheet along guide member 130 into contact with photoconductive surface 12 so as to enable the next successive toner powder image to be transferred to the common surface of the sheet of support material. In this manner, successive toner powder images may be transferred to the same surface of the sheet. This is highly significant if one portion of a copy is desired to be reproduced in red while another portion thereof is desired to be reproduced in black. In this case, two original documents are employed. One of the original documents contains the information being reproduced in black, while the other original document contains the information being reproduced in black. The operator depresses the red-black button (FIG. 4) actuating the appropriate circuitry to position guide member 66 in communication with guide member 70, i.e. in the recirculating mode. The operator then places the original document containing the information to be reproduced in black on platen 18. Thereafter, the operator depresses the black button (FIG. 4) so that developer unit 32, i.e. the developer unit containing the black toner particles will be energized. In this manner, the electrostatic latent image produced from the first original will be developed with black toner particles. After the black toner powder image is fixed permanently to the copy sheet, the copy sheet is advanced to tray 114. The operator then places a second original containing the information to be reproduced in red onto platen 18 and depresses the red button (FIG. 4). Guide member 66 now moves into communication with guide member 68 so as to advance the copy sheet to catch tray 78. The electrostatic latent image created from the second original document is developed with red toner particles by developer unit 34. The red toner powder is transferred to the copy sheet and fused thereto. After fusing, the copy sheet with the red and black information thereon moves to catch tray 78 for subsequent removal therefrom by the machine operator. It should be noted that the information recorded on both of the original documents may be in black. This will result in a single copy sheet having the information of both originals, one being in red and the other being in black.

An alternate embodiment of the present invention enables successive toner powder images to be transferred to opposed surfaces of the sheet of support material. In this mode of operation, guide member 66 is pivoted so as to be in operative communication with a third tray (not shown) identical to tray 114. The sheet of support material, with the first toner powder image opposed thereto, is then advanced to this third tray. Tray 114 holds the sheet of support material with the toner powder image thereon face down so as to enable successive toner powder images to be transferred to a common surface of the sheet of support material. This third tray holds the sheet of support material such that the toner powder image thereon is face up. In this manner, the sheet of support material is advanced from the third tray through suitable guide members via the corresponding advancing rolls into operative communication with photoconductive surface 12. However, in this instance, the oppose surface is positioned in contact with photoconductive surface 12. Thus, successive toner powder images may now be transferred to opposed surfaces of the sheet of support material. This is particularly significant wherein successive black images may be transferred to opposed surfaces of the sheet of support material, or, wherein it is desired to transfer a black image to one surface and a red image to the other surface or a combination of either of the foregoing. It is, therefore, evident, that the preceding sheet path enables successive toner powder images to be transferred to a common surface or opposes surfaces of the sheet of support material. Thus, in the simplex mode of operation, successive single color toner powder images may be transferred to a common surface of the sheet of support material, while in the duplex mode of operation, successive toner powder images may be transferred to opposed surfaces of the sheet of support material.

With continued reference to FIG. 1, blank sheets of support material are disposed in tray 115 and advanced therefrom by pivotably mounted roller 117. The blank sheet advances from tray 115 through guide member 119 into contact with photoconductive drum 10 at transfer station D where the first toner powder image is transferred to the sheet. Thereafter, the copy sheet may be moved to catch tray 78 for removal from the printing machine or to tray 114 for subsequent recirculation. An example of the operation of the printing machine will be described with reference to FIG. 4 wherein the control panel is discussed in greater detail.

Figure 2:
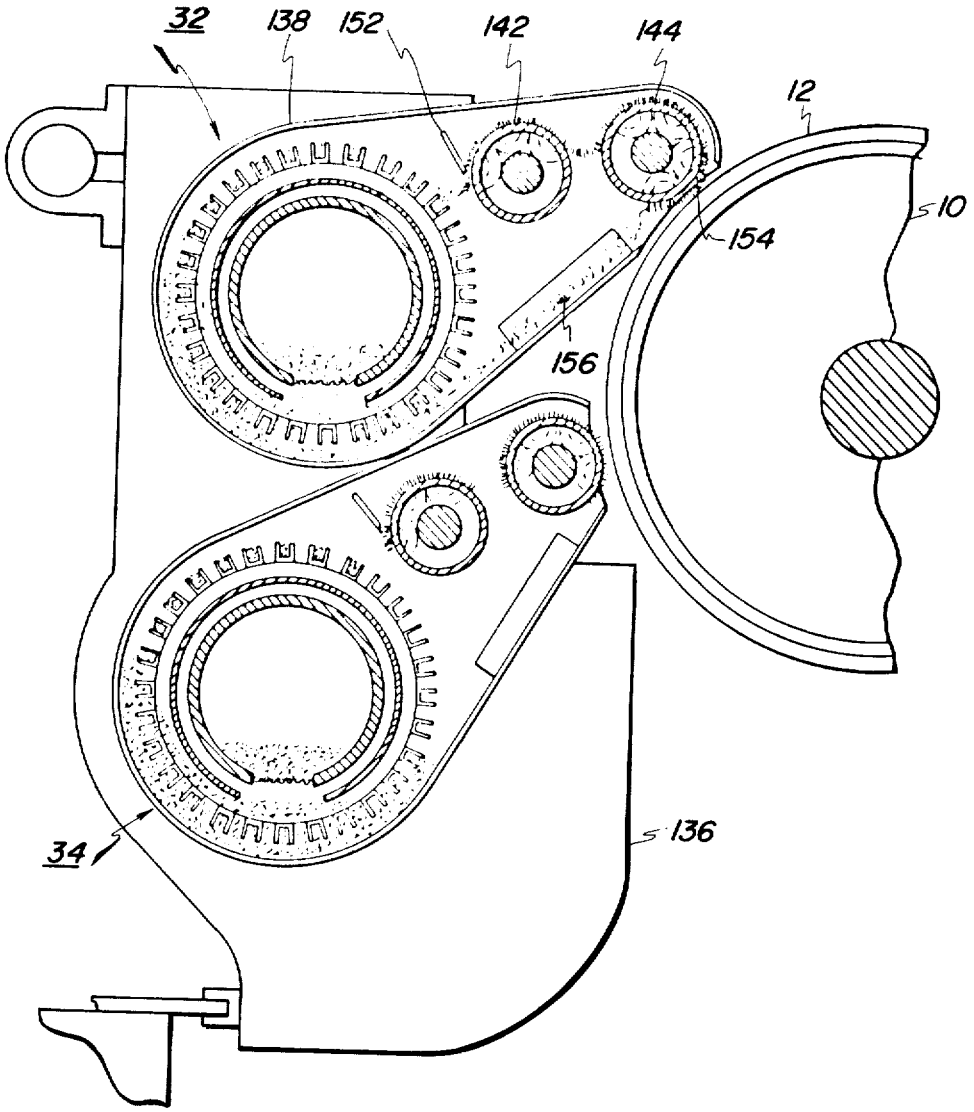
FIG. 2 is a sectional elevational view of the development system used in the FIG. 1 printing machine.

Turning now to FIG. 2, there is shown the development system of the printing machine. The development system includes frame 136 which supports two toner depositing means or development units 32 and 34, respectively. The aforementioned development system is of the magnetic brush type. These development units are depicted in an elevational sectional view to indicate more clearly the various components included therein. Only development unit 32 will be described in detail inasmuch as developer unit 34 is nearly identical thereto, the distinction between the developer units being the color of the toner particles contained therein and minor geometrical differences due to the mounting arrangement. Developer unit 32 may have black toner particles and unit 34 red toner particles.

The principle components of developer unit 32 are a developer housing 138, paddle wheel 140, transport roll 142 and developer roll 144. Paddle wheel 140 is a cylindrical member with buckets or scoops around the periphery thereof and is adapted to rotate so as to elevate developer mix 146 from the lower region of housing 138 to the upper region thereof. When developer mix 146 reaches the upper region of housing 138, it is lifted from the paddle wheel buckets to transport roll 142. Alternate buckets of paddle wheel 138 have apertures in the root diameter so that the developer mix in these areas is not carried to transport roll 142, but instead, falls back to the lower region of developer housing 138 cascading over shroud 148. Shroud 148 is of a tubular configuration with aperture 150 in the lower region thereof. Developer mix 148 is recirculated so that the carrier granules are continually agitated to mix with fresh toner particles. This generates a strong triboelectric charge between the carrier granules and toner particles.

As developer mix 146, in the paddle wheel buckets, approaches transport roll 142, the magnetic fields produced by the fixed magnets therein attract developer mix 146. Transport roll 142 moves developer mix 146 in an upwardly direction by the frictional force exerted between the roll surface and developer mix. A surplus of developer mix is furnished, and metering blade 152 is provided to control the amount of developer mix carried over the top of transport roll 142. The surplus developer mix 146 is sheared from transport roll 142 and falls in a downwardly direction toward paddle wheel 140. As the surplus developer mix descends, it falls through the apertures of paddle wheel 140 in a downwardly direction into the lower region of housing 138. The developer mix which passes metering blade 152 is carried over transport roll 142 to developer roll 144 and into development zone 154 located between photoconductive surface 12 and developer roll 144. The electrostatic latent image recorded on photoconductive surface 12 is developed by contacting the moving developer mix 146. The charged areas of photoconductive surface 12 electrostatically attract the toner particles from the carrier granules of developer mix 146. Upon passing from the development zone, the unused developer mix and denuded carrier granules enter a region relatively free from magnetic forces and fall from developer roll 144 in a downwardly direction to the lower region of developer housing 138. As the unused developer mix and denuded carrier granules descend, they pass through mixing baffle 156 which diverts the flow from the edge towards the center of housing 138 to provide mixing in this direction.

Figure 3:
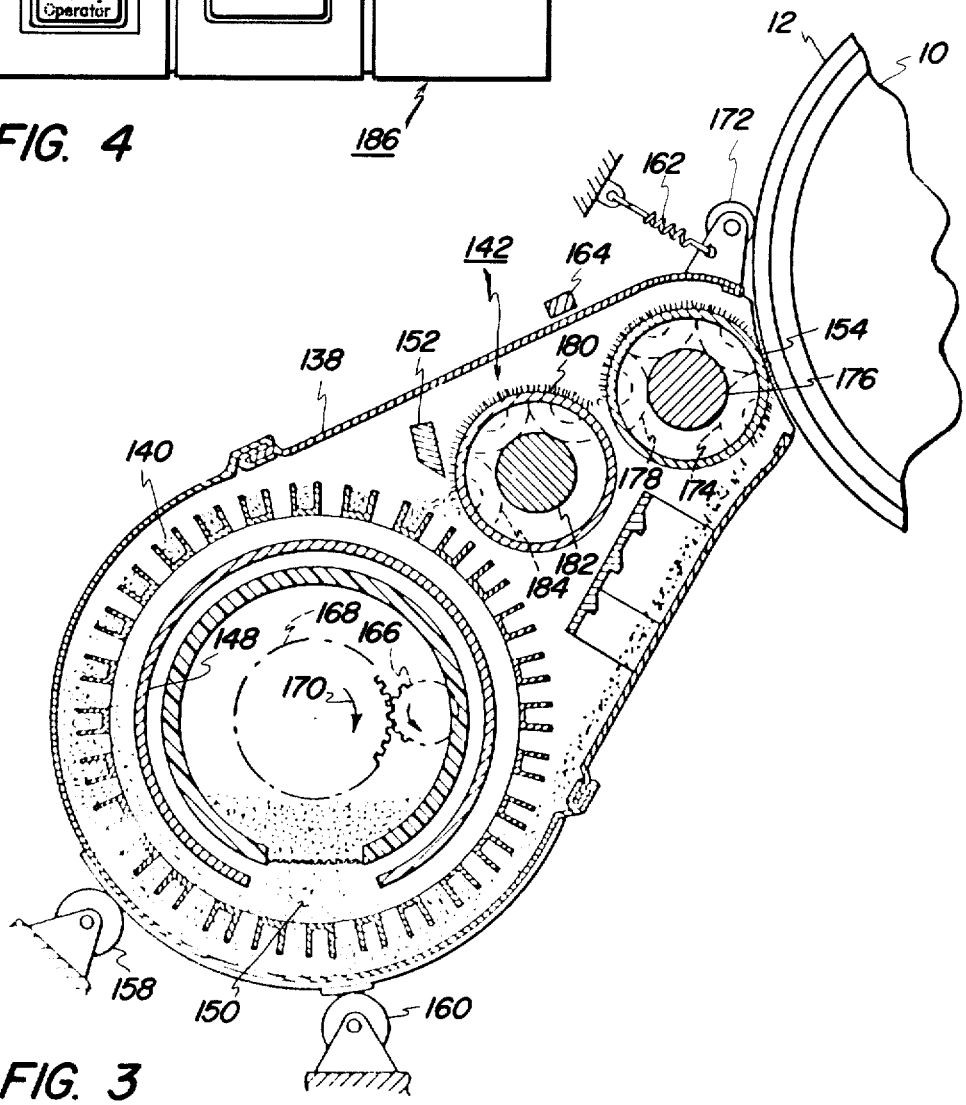
FIG. 3 is a fragmentary, sectional elevational view describing, in detail, one of the developer units shown in the FIG. 2 development system.

Turning now to FIG. 3, the operation of developer unit 32 will be discussed in greater detail. Developer housing 138 is pivoted about the center of paddle wheel 140, and is supported at the lower region of the exterior surface by rollers 158 and 160 mounted rotatably in frame 136. Spring 162 pivots developer housing 138 against stop 164. In this position, developer roll 144 is in the non-operative position spaced from photoconductive surface 12. Operation is initiated when clutch gear 166 meshes with gear 168 which is attached to paddle wheel 140, thereby causing paddle wheet 140 to revolve clockwise as indicated by arrow 170. As gear 168 and paddle wheel 140 start to rotate, a reaction torque is exerted against developer housing 138 due to the resistance to motion of developer mix 146 which fills developer housing 138. This reaction torque causes housing 138 to rotate clockwise against the force of spring 162 until a stop, shown as a wheel 172, is positioned against drum 10. Rolls 142 and 144 are rotated in conjunction with paddle wheel 140 by a gear (not shown). When the latent image recorded on photoconductive surface 12 of drum 10 has passed development station 154, development action is discontinued and the developer mix removed from contact with photoconductive surface 12. To achieve this, the drive motor is disconnected from gear 166 by de-energizing the clutch leaving gear 166 free to rotate in either direction. Paddle wheel 140, developer roll 144 and transport roll 142 stop rotating, and developer housing 138 is pivoted clockwise by spring 162 until it engages stop 164 in its operative position. This completes the cycle.

The aforementioned procedure has been described for developer unit 32, however, this procedure is repeated for developer unit 34 also. In the formation of black image developer unit 32 is positioned in contact with the electrostatic latent image, whereas in the formation of a red copy, developer unit 34 contacts the electrostatic latent image. Furthermore, the combination of red and black images may be created by forming successive toner powder images on photoconductive surface 12. For example, initially, a black toner powder image may be created by moving developer unit 32 into operative communication with photoconductive surface 12. Subsequently, a red toner powder image may be formed by moving developer unit 34 into operative communication with photoconductive surface 12.

In the preferred embodiment thereof, developer means or roll 144, as best shown in FIG. 3, includes a non-magnetic tubular member 174, preferably made from an aluminum tube having an irregular or roughened exterior surface. Tubular member 174 is journaled for rotation by suitable means such as ball bearing mounts. A shaft 176, made preferably of steel, is mounted within tubular member 144 and serves as a fixed mounting for magnetic means 178. Magnetic means 178, preferably, includes magnets made of barium ferrite in the form of an annular ring and is arranged with five poles on about a 284° arc about shaft 176.

Similarly, transport means or roll 142 includes a non-magnetic tubular member 180. Tubular member 180 is also preferably made from an aluminum tube having an irregular or roughened exterior surface. Tubular member 180 is journaled for rotation by suitable means such as ball bearing mounts. A shaft 182, preferably made of steel, is concentrically mounted within tubular member 180 and functions as a fixed mounting for magnetic means 184. Magnetic means 184, preferably, includes barium ferrite magnets in the form of annular rings arranged with four poles on about a 180° arc about shaft 182.

Each of the toner depositing means or developer units 32 and 34, respectively, is actuated by a timing disc mounted on the shaft of drum 10 and operatively associated with the machine logic. The timing disc (not shown) is opaque with a plurality of spaced slots in the circumferential periphery thereof. The timing disc is arranged to be interposed between an illuminating source and a photosensor which generates an electrical signal as each slot permits the light rays to pass through the disc. This electrical signal, in association with the suitable machine logic, activates the appropriate developer unit. For example, if the machine operator depresses the button indicating that only a black and white copy is to be reproduced, the timing disc, in association with the machine logic will only activate developer unit 32. After the photoconductive surface has rotated through an appropriate angle, a slit in the timing disc permits the light rays from the illuminating source to once again cause the photosensor to generate a second electrical signal, which in association with the machine logic, deactivates the developer unit. The development system hereinbefore discussed is disclosed in further detail in copending application Ser. No. 255,259 filed in 1972, now U.S. Pat. No. 3,854,449, the disclosure of which is hereby incorporated into the present application.

Turning now to FIG. 4, the detailed operation of the printing machine will be described with reference to control panel 186 shown therein. Initially, the machine operator will depress the Power On button activating the machine. Thereafter, the operator selects the mode of operation desired. For example, if a copy is reproduced with only a black image on one surface of the sheet of support material, the operator simply depresses the Black button. Contrawise, if a red image where to be produced, the operator would depress the Red button. In this way, the appropriate developer unit is actuated and guide means 66 is placed in operative communication with guide member 68. Thus, after the initial toner powder image is deposited onto the copy sheet, the copy sheet advances to catch tray 78. If the machine operator desired to have both a red and a black copy created, the Red-Black would be depressed. This initially positions guide member 66 in communication with guide member 70 so as to recirculate the sheet of support material. The operator then places the original document having the information to be reproduced in black on platen 18. Thereafter, the operator depresses the Black button and a copy having the black information thereon is formed. This copy sheet is advanced to auxiliary tray 114. When the copy sheet arrives in tray 114, it triggers a lead switch which actuates the solenoid associated with guide member 66. Guide member 66 is then pivoted so as to be in communication with guide member 68. The operator then places a new original on platen 18. This second original contains the information to be reproduced in red. The operator then depresses the Red button and the copy sheet having the black information thereon is advanced to the transfer station where the red information is placed thereon. Thereafter, the copy sheet having the black and red information is advanced to catch tray 78. While the foregoing sequence produces first a black image and then a red image, one skilled in the art will appreciate that this sequence may be reversed, i.e., first forming a red image and then a black image on the copy sheet.

If, however, a two-sided copy is being produced and the printing has a third tray, the operator must now select the desired color combination for each side of the copy sheet. For example, if the operator desires side 1 to be black, the operator would depress the appropriate button, black button, if side 2 is to be red, the corresponding red button would then be depressed. Note, however, an additional Duplex button would be added to control panel 186 positioning guide member 66 in communication with a third tray. In this manner, the appropriate developer units are actuated as well as pivoting guide member 66 to the appropriate position inverting the sheet of support material. Thus, if side 1 were black, the corresponding developer unit would produce a black toner powder image. This black toner powder image is transferred to the first surface of the sheet of support material. Actuating the Duplex button positions guide member 66 in operative communication with the third tray (not shown) so as to advance the sheet of support material with the black toner powder image thereto face up. The sheet advances therefrom into the corresponding guide members which place the opposed surface thereof in communication with photoconductive surface 12 enabling the red toner powder image to be transferred thereto. Thereafter, the sheet of support material is once again advanced through the appropriate guide members to guide member 66 which is now in operative communication with guide member 68 so as to advance the sheet of support material to catch tray 78.

Similarly, red and black copies may be created on each surface of the sheet of support material in the duplex mode. This is accomplished by depressing the side 1 red and black button and the side 2 red and black button as well as the Duplex button. In this mode of operation, the sheet of support material is recirculated so as to enable a red toner powder image and a black toner powder image to be initially transferred to a common surfaces, i.e., side 1 of the sheet of support material. Thereafter, the sheet of support material is inverted so as to enable successive red and black toner powder images to be transferred to the oppose surface thereof. Thus, in the foregoing mode of operation, the sheet of support material will pass through a recirculating mode, so as to enable a red and black toner powder image to be formed on a common surface of the sheet of support material and then an inverting mode so as to enable the next powder image to be deposited on the opposed surface of the sheet of support material and once again, a recirculating mode so as to enable the final toner powder image to be transferred to the opposed surface of the sheet of support material.

In recapitulation, the electrophotographic printing machine depicted in FIG. 1 is adapted to create black and red color copies from a pair of original documents. An alternate embodiment described herein permits simplex and duplex copies to be created. Hence, it is feasible for the machine operator, employing the printing machine in FIG. 1 or an alternate thereof, to create a copy having red and black information on one or both sides thereof.

Thus, it is apparent that there has been provided in accordance with the present invention an electrophotographic printing machine that fully satisfies the objects, aims and advantages set forth above. While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrostatographic printing machine of the type having successive differently colored powder images deposited on an image bearing member and means for transferring the differently colored powder images from the image bearing member to different portions of a sheet of support material, wherein the improvement includes:

a receiving station;

a supply station;

a plurality of transport members connecting said supply station with said receiving station defining a plurality of paths therebetween;

means for advancing the sheet of support material along one of said plurality of transport members from said supply station to said receiving station with a first one of said transport members moving the sheet of support material to said receiving station after the transfer of a single powder image to a first surface thereof, and a second one of said transport members recirculating the sheet of support material so that successive differently colored powder images are transferred to different portions of the first surface thereof as the sheet of support material advances from said supply station to said receiving station;

means operatively associated with said advancing means, for selecting one of said plurality of transport members for moving the sheet of support material therealong; and means for inverting the sheet of support material so that said advancing means moves the sheet of support material along one of said transport members, thereby transferring at least one powder image to a second surface opposed from the first surface of the sheet of support material.

2. A printing machine as recited in claim 1, further including means for fixing substantially permanently the powder image to the sheet of support material.

3. An electrostatographic printing machine of the type having successive powder images deposited on an image bearing member and means for transferring the powder images from the image bearing member to a sheet of support material, wherein the improvement includes:

a receiving station;

a supply station;

first tranport means for moving the sheet of support material from said supply station to the transfer means;

second transport means for moving the sheet of support material from the transfer means;

means for housing a sheet of support material having a powder image thereon;

means for feeding the sheet of support material from said housing means;

third transport means, operatively associated with said housing means, for moving the sheet of support material fed therefrom to the transfer means;

fourth transport means for moving the sheet of support material to said housing means with the surface having the powder image thereon being face down;

fifth movable transport means, said fifth transport means being movable to a first position connecting said second transport means with said receiving station so as to advance the sheet of support material thereto, and said fifth transport means being movable to a second position connecting said fourth transport means with said second transport means;

means for moving said fifth transport means to the first position so that the sheet of support material advances to said receiving station after the transfer of a single powder image to a first surface thereof, said moving means positioning said fifth transport means in the second position so that the sheet of support material advances to said housing means with the first powder image on the first surface thereof so that said feeding means advances the sheet of support material to said third transport means which moves the sheet of support material to the transfer means permitting a second powder image to be transferred to the first surface thereof; and means for inverting the sheet of support material so as to transfer successive powder images to the second surface and the first surface thereof.

4. An electrophotographic printing machine, including:

a photoconductive member;

means for charging said photoconductive member to a substantially uniform potential;

means for exposing said charged photoconductive member to differently colored light images recording single color electrostatic latent images thereon;

means for developing the electrostatic latent images recorded on said photoconductive member with differently colored toner particles forming differently colored toner powder images thereon;

means for transferring the differently colored toner powder images from the electrostatic latent images to different portions of a sheet of support material;

a receiving station;

a supply station;

a plurality of transport members connecting said supply station with said receiving station defining a plurality of paths therebetween;

means for advancing the sheet of support material along one of said plurality of transport members from said supply station to said receiving station with a first one of said transport members moving the sheet of support material to said receiving station after the transfer of a single toner powder image to a first surface thereof, and a second one of said transport members recirculating the sheet of support material so that successive differently colored toner powder images are transferred to different portions of the first surface thereof as the sheet of support material advances from said supply station to said receiving station;

means, operatively associated with said advancing means, for selecting one of said plurality of transport members for moving the sheet of support material therealong; and means for inverting the sheet of support material so that said advancing means moves the sheet of support material along one of said transport members, thereby transferring at least one powder image to a second surface opposed from the first surface of the sheet of support material.

5. A printing machine as recited in claim 4, further including means for fixing substantially permanently the toner powder image to the sheet of support material.

6. A printing machine as recited in claim 5, wherein said exposing means includes:

a light source arranged to illuminate an original document disposed in the printing machine; and lens means for receiving the light rays from the original document to form a light image thereof.

7. An electrophotographic printing machine, including:

a photoconductive member;

means for charging said photoconductive member to a substantially uniform potential;

means for exposing said charged photoconductive member to a light image recording an electrostatic latent image thereon;

means for developing the electrostatic latent image recorded on said photoconductive member with toner particles;

means for transferring the toner powder image from the electrostatic latent image to a sheet of support material;

a receiving station;

a supply station;

first transport means for moving the sheet of support material from said supply station to said transfer means;

second transport means for moving the sheet of support material from said transfer means;

means for housing a sheet of support material having a toner powder image thereon;

means for feeding the sheet of support material from said housing means;

third transport means, operatively associated with said housing means, for moving the sheet of support material fed therefrom to said transfer means;

fourth transport means for moving the sheet of support material to said housing means with the surface having the toner powder image thereon being face down;

fifth movable transport means, said fifth transport means being movable to a first position connecting said second transport means with the receiving station so as to advance the sheet of support material thereto, and said fifth transport means being movable to a second position connecting said fourth transport means with said second transport means;

means for moving said fifth transport means to the first position so that the sheet of support material advances to said receiving station after the transfer of a single toner powder image to a first surface thereof, said moving means positioning said fifth transport means in the second position so that the sheet of support material advances to said housing means with the first toner powder image on the first surface thereof so that said feeding means advances the sheet of support material to said third transport means which moves the sheet of support material to said transfer means permitting a second toner powder image to be transferred to the first surface thereof; and means for inverting the sheet of support material so as to transfer successive toner powder images to the second surface and the first surface thereof.

* * * * *